United States Patent [19]

Dobbs

[11] 4,203,364

[45] May 20, 1980

[54] CARTRIDGE FOR REDUCING BORE EROSION AND EXTENDING BARREL LIFE

[76] Inventor: Herbert H. Dobbs, 23 Dupont Way, Wright-Patterson AFB, Ohio 45433

[21] Appl. No.: 916,167

[22] Filed: Jun. 16, 1978

[51] Int. Cl.[2] ..... F42B 31/02

[52] U.S. Cl. ..... 102/38 WR; 102/92; 102/93

[58] Field of Search ..... 102/38 WR, 92, 93, 95

[56] References Cited

U.S. PATENT DOCUMENTS

| | | | |
|---|---|---|---|
| 671,708 | 4/1901 | Noble | 102/38 WR |
| 700,983 | 5/1902 | Scruggs | 102/38 WR |
| 1,031,320 | 7/1912 | Brown | 102/92 |
| 1,189,011 | 6/1916 | Smith | 102/38 WR |

*Primary Examiner*—Harold J. Tudor

*Attorney, Agent, or Firm*—Nathan Edelberg; Robert P. Gibson; Robert O. Richardson

[57] ABSTRACT

A liquid filled plastic capsule placed immediately behind the projectile is forced against the projectile base when the propellant charge is ignited. This action ruptures a diaphragm in the forward face of the capsule, releasing the encapsulated liquid and forcing it into the space around the projectile. The resulting liquid film acts as a lubricant and obturator between the projectile and barrel and as a cooling film for the barrel. The ruptured capsule serves as a piston, keeping the powder gases separated from the liquid surrounding the base of the projectile and forcing the liquid to flow between the projectile and the surface of the bore. This results in reducing bore erosion and extending barrel life. The capsule might be placed in the neck of the cartridge in the case of fixed ammunition or attached to the base of the projectile in the case of separate loading ammunition.

2 Claims, 3 Drawing Figures

CARTRIDGE FOR REDUCING BORE EROSION AND EXTENDING BARREL LIFE

GOVERNMENT RIGHTS

The invention described herein may be manufactured and/or used by or for the Government for governmental purposes without the payment of any royalty thereon.

BACKGROUND OF THE INVENTION

The problem solved by the present invention is that of extending barrel life in firearms by reducing bore erosion and alleviating overheating. All firearms experience bore erosion to some degree. However, it becomes a serious problem mainly in automatic weapons, high velocity weapons, and large caliber cannons. Bore erosion is caused by several factors whose significance varies with the type of weapon. Actually, removal of material from the surface of the bore occurs because of the mechanical action either of projectiles passing through the barrel or of the high velocity, hot gases driving the projectiles. Thermal and chemical effects aid these processes. Many weapons use rifling to spin the projectile in order to stabilize it in flight. In such weapons, either the projectile (normally the case with small arms) or the projectile's rotating band (normally the case with the larger weapons) must be slightly larger in diameter than the land diameter of the barrel. The lands (i.e., rifling—spiraled ridges in the bore) then engrave the projectile (or its rotating band) to impart a rotation to it as it passes through the barrel. This intimate mechanical interaction between the projectile and bore is a primary source of bore erosion.

In automatic weapons, however, damage effects are initiated by overheating. The principle source of this heat is the hot propellant gas. Barrels are subject to increased frictional wear when very hot, as the heat affects both barrel and projectile dimensional tolerances and metal properties. In the extreme case, the barrel material may soften to where permanent deformation or warping occurs. This problem is so severe in machine guns that they are usually built with quick change barrels. In ordinary usage, this permits quickly changing barrels with a resulting extension of individual barrel life (the hot barrel is allowed to cool before it is used again). Even so, a machine gun can easily wear out a dozen or more barrels before the remaining weapons components are significantly worn. In combat use, it is not uncommon for barrels to be fired until the heat destroys them before they are replaced. Barrel life is greatly reduced under such conditions. It is apparent that significantly reduced heating and bore erosion would significantly improve weapon effectiveness in such circumstances, as well as providing extended service life. It is equally apparent that weapons without replaceable barrels would have extended service lives if bore erosion could be reduced.

In large caliber weapons, bore erosion is less a consequence of overall thermal effects and the direct mechanical interaction of the projectile with the barrel than of gas erosion. Obturation between the projectile and barrel is normally not perfect. Hot gas expands through any minor crack in the barrel surface around the projectile obturator. Since the gas pressure behind the projectile is on the order of 40,000 pounds per square inch, and its temperature on the order of 2000° K. or more, this gas flow is very similar to that through a rocket nozzle. The melting point of the barrel metal is momentarily exceeded and, due to the confined flow passages and consequent thin boundary layers in the microscopic cracks where cannon barrel erosion begins, metal is carried away by the expanding gases. This occurs mainly at the origin of rifling, where the projectile has not yet had time to move. It is shown by the "worm eaten" appearance of the interior surface of a worn cannon barrel immediately in front of its chamber. Due to the much greater viscosity of a liquid (over a gas), when forced into the space around the projectile at the beginning of firing a liquid should be able to greatly impede the gas flow through crevices in the barrel surface around the projectile, thus stopping bore erosion at its point of origin. This is what this invention would propose to do.

In low rate-of-fire small caliber fire arms (single-shot, bolt-action, semi-automatic, etc.), bore erosion is primarily due to the mechanical interaction between the projectile and the barrel. For low muzzle velocity fire arms (i.e., under 3000 feet per second) of this type, bore erosion is normally not a serious problem and long barrel lives are the rule. As muzzle velocity increases, the bore erosion problem increases with it, until at the so called hyper-velocities (over 10,000 feet per second muzzle velocity), it is questionable whether the forces between the projectile and barrel will permit the use of rifling. At such velocities, even with a smooth bore weapon (probably using finned projectiles, for stability in flight), it would appear likely that a liquid film between the projectile and barrel surface may be needed to allow a useful barrel life. This area is one current interest in weapons research and development.

SUMMARY OF THE PRESENT INVENTION

Experimental use of liquid propellants has shown a significant reduction in bore erosion. While liquid propellants are still highly experimental, the present invention provides a method of utilizing this concept with current solid propellants. This is accomplished with small caliber, fixed ammunition by inserting a liquid filled plastic capsule immediately behind the projectile in a conventional cartridge. The capsule is so designed that when the cartridge is fired the liquid is released and forced between the projectile and barrel during the projectile's passage through the barrel. The resulting liquid film acts as a lubricant and obturator between the projectile and the interior surface of the barrel. This reduces friction and heat transfer to the barrel, thereby reducing bore erosion. Additionally, increased obturation or sealing between the projectile and the barrel is provided by the liquid film. This is desirable to achieve optimum performance from the round of ammunition. This is especially true with badly worn barrels.

The liquid provides a thermal resistance layer, restricting heat transfer from the power gases to the barrel, and also acts as a cooling agent. As previously stated, barrels wear faster when hot and may be permanently damaged by excessive heat. It is therefore desirable to keep the barrel as cool as possible. An additional benefit resulting from the use of the liquid capsule is a reduction in muzzle flash. This is especially important in military weapons where an excessively bright muzzle flash could reveal a soldier's exact position.

DETAILED DESCRIPTION OF ILLUSTRATIVE EMBODIMENTS

Figure 1:
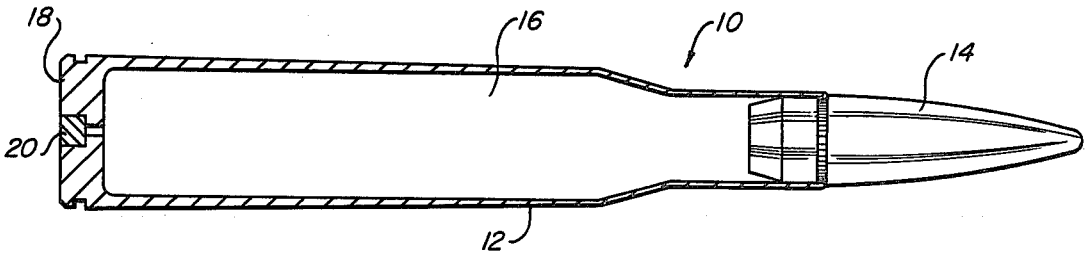
FIG. 1 is a sectional view of a conventional ammunition cartridge.

Reference is made to FIG. 1 wherein there is shown a conventional ammunition cartridge 10. As shown, the cartridge 10 includes a casing 12 which supports a projectile 14 in one end. The casing 12 is filled with a powdered or flaked propellant 16. The base end 18 of the casing 12 is provided with a percussion detonated primer 20 to fire the cartridge. This view is shown for comparison and to show how the present invention may be adapted to existing cartridge configurations.

Figure 2:
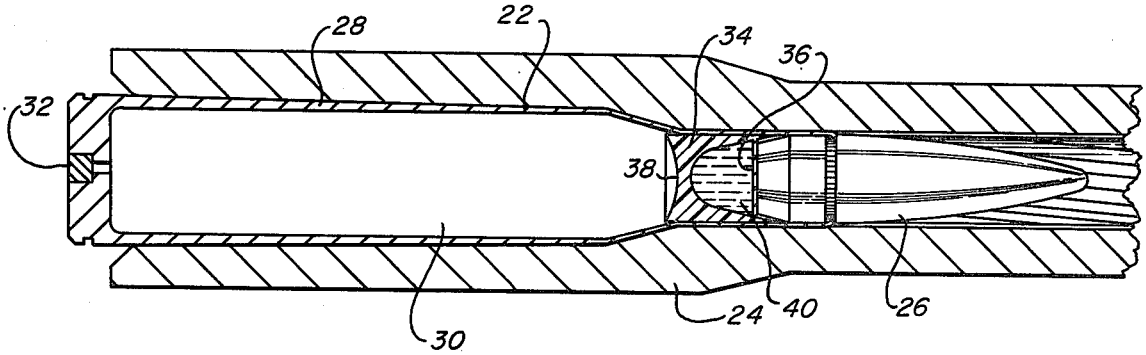
FIG. 2 is a sectional view of a chambered cartridge incorporating the present invention.

FIG. 2 shows an ammunition cartridge 22 as modified in accordance with the present invention and inserted in a weapon chamber 24. This cartridge 22 has a projectile 26, casing 28, propellant 30, and primer 32 similar to that of the conventional cartridge 12 shown in FIG. 1. Additionally, positioned immediately behind the projectile 26 is a liquid filled plastic capsule 24. The foremost portion 36 of the capsule is a very thin diaphram and is designed to rupture when the round is fired. The rearward wall 38 is comparitively thick and is designed to resist collapsing when the round is fired. The area between the walls 36 and 38 is filled with a lubricating, cooling liquid 40, such as water for example.

Figure 3:
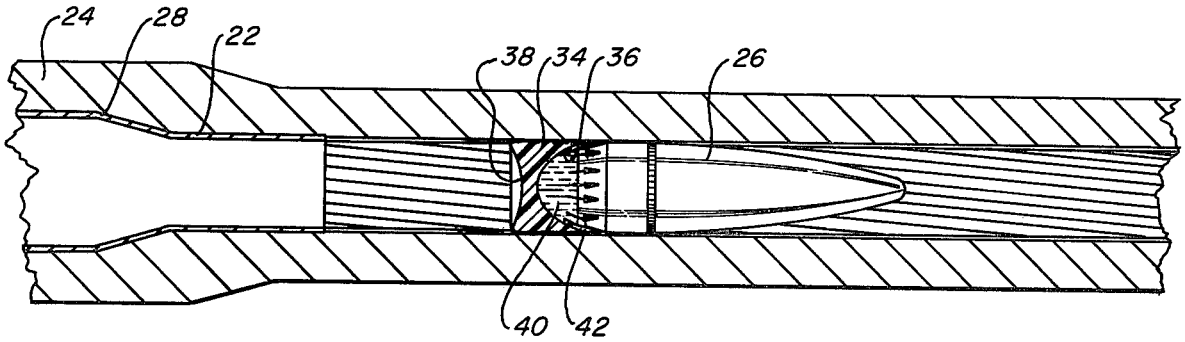
FIG. 3 is a sectional view of the cartridge in FIG. 2 but immediately after firing with the projectile already moving through the barrel.

As shown in FIG. 3, the capsule 34 moves forward slightly relative to the projectile 26 upon firing. This action causes the front wall 36 of the capsule 34 to rupture. The coolant lubricant 40, displaced by the projectile 26, is forced out of the capsule 34 and flows out around the projectile as indicated by arrows 42. In this manner, the projectile 26 is lubricated during its passage through the barrel. The resulting liquid film acts as a lubricant and obturator between the projectile and barrel and as a cooling film for the barrel. The ruptured capsule 34 serves as a piston keeping the powder gases separated from the liquid surrounding the base of the projectile and forcing the liquid to flow between the projectile and the surface of the bore.

Although it is difficult to calculate accurately the barrel cooling effect, the following approximations apply to a standard 30 caliber weapon:

| | |
|---|---|
| Powder weight | 50 grains or 0.0071 lbs. |
| Powder energy | 1500 BTU/lb. |
| Bullet weight | 150 grains or 0.021 lbs. |
| Muzzle velocity of bullet | 2700 ft./sec. |
| Muzzle velocity of gases (at time of bullet muzzle exit) | 6000 ft./sec. |
| Gas temperature at bullet muzzle exit | 1700° K. |
| Barrel weight | 3 lbs. |
| Barrel length | 24 inches |
| Specific heat of steel | 0.01 BTU/lb. ° R. |
| Specific heat of gases | 0.3–0.5 BTU/lb. ° R. |
| Heat of vaporization of water | 1000 BTU/lb. |

The combustion energy of the powder charge is: $1500\times0.0071=10.71$ BTU. The kinetic energy of the bullet is: $(\frac{1}{2})(0.021)(2700)^2/(32.2)(778.2)=3.11$ BTU. The kinetic energy of the powder gases is assumed to be $\frac{1}{3}$ that of the bullet or 1.04 BTU.

The heat energy of the powder gases (68° F. day)—should fall in the range between $(0.0071)(1700-273-20)1.8(0.3)=5.43$ BTU and the difference between the available combustion energy and the sum of the kinetic energies $10.71-(3.11+1.04)=6.56$ BTU.

It appears the maximum energy which might be absorbed by the barrel walls would be $10.71-3.11-1.04-5.43=1.13$ BTU.

This would indicate a barrel temperature rise of $1.13/(3.0\times0.1)=3.8°$ F./round once the energy was evenly distributed. The heat transfer rate and the temperature rise per round fired, of course, would decrease substantially as the barrel temperature increased.

Assuming a water filled capsule containing $(0.125)^2(3.1416)(0.5)=0.025$ cubic inches, sufficient to form a 0.002" film over the bore, vaporization of this liquid will absorb approximately $(0.025)(0.036)1000=0.886$ BTU. Assuming an efficient energy transfer from the barrel to the liquid, the temperature rise is reduced to $(1.130-0.886)/(3.0\times0.1)=0.8°$ F./round. From the foregoing example it can be seen that a significant reduction in temperature in firing automatic weapons, high velocity weapons and large cannon can be obtained with the practice of the present invention. By correct choice of type and volume of liquid, it is possible to limit barrel temperature rise to an acceptable maximum value high enough to balance heat input per round yet low enough for the weapon to still operate satisfactorily.

Other candidates than water for use as the lubricating, cooling liquid are, of course, possible (e.g., methanol, ethanol, acetone, dibutylphthalate, dioctylphthalate, fluorocarbons, etc.). In practice it also may be necessary for the liquid to contain suitable additives in solution, in suspension, or as emulsions. These are required to make the ammunition storable and useable over an acceptable environmental temperature range (nominally −65° F. to 150° F.) and to give the liquid the properties needed to provide the desired improvement in barrel life. In addition to the liquids mentioned previously, more than one of which may be used in combination, such additives may include (but are not limited to) lubricants such as molybdenum disulfide in particle form, wetting agents such as various detergents, and gelling agents which can provide a way of maintaining uniform mixing of the contents of the capsule in storage and until the cartridge is fired. The rheological properties of gels can be made such that they become liquids only under the high pressures experienced during firing.

While the present invention has been described in connection with a unitary round of ammunition, it also has application in which the projectile and propellant are separately loaded, the plastic capsule 34 obviously being inserted in between.

The invention in its broader aspects is not limited to the specific combinations, improvements, and instrumentalities described, but departures may be made therefrom within the scope of the accompanying claims without departing from the principles of the invention and without sacrificing its chief advantages.

What is claimed is:

1. An ammunition cartridge for firearms, whereby the use of said cartridge results in reduced bore erosion and extended barrel life, said cartridge comprising:

an exterior casing, said casing having a projectile at one end and detonating means at the other end, said casing being substantially filled with an explosive propellant, said cartridge having a rupturable coolant-lubricant containing capsule positioned immediately behind said projectile within said casing, said capsule being substantially cylindrical and having front and rear walls and a coolant-lubricant contained therebetween, said front wall being very thin so as to rupture and release said lubricant when said cartridge is detonated, said rear wall being comparatively thick and biconcave in cross section so as to resist collapse when said cartridge is detonated, said capsule, when ruptured, serving as a piston to keep powder gases separated from said liquid around the base of said projectile and forcing said liquid to flow between said projectile and the surface of the bore of the firearm barrel.

2. An ammunition cartridge as set forth in claim 1 wherein said coolant lubricant is water and such alternative liquids and additives as are needed to operate over the required temperature range and produce the desired improvement in weapons performance.

* * * * *